US005505379A

United States Patent [19]

Wagner

[11] Patent Number: 5,505,379

[45] Date of Patent: Apr. 9, 1996

[54] FORCED AIR REGISTER WITH LOUVER CONTROL AND METHOD OF CONSTRUCTION THEREOF

[76] Inventor: Dane Wagner, P.O. Box 211291, Anchorage, Ak. 99521-1291

[21] Appl. No.: 412,009

[22] Filed: Mar. 28, 1995

[51] Int. Cl.[6] ..... F24F 7/00

[52] U.S. Cl. ..... 236/49.5; 236/101 D; 454/258; 49/77.1

[58] Field of Search ..... 236/49.5, 101 D; 454/258, 314, 315, 335; 49/77.1

[56] References Cited

U.S. PATENT DOCUMENTS

| | | | |
|---|---|---|---|
| 3,145,642 | 8/1964 | Radcliff | 454/315 |
| 3,552,295 | 2/1969 | Armstrong | 454/315 |
| 4,493,456 | 1/1985 | Sarazen, Jr. | 236/49.5 |
| 5,364,303 | 11/1994 | Terry | 454/315 |

*Primary Examiner*—John M. Sollecito

*Attorney, Agent, or Firm*—Michael Tavella

[57] ABSTRACT

The present device is a movable-louver heating and cooling register. The register is designed to have the same overall dimensions of commercial registers available today. The heating and cooling register has movable louvers installed on pivots that are formed in the register body. Two control arms are used to pivot the groups of louvers. The control arms are mounted on diagonals from each other. Both control arms are attached to a central control shaft, which is designed to rotate about its central axis. Because the control arms are mounted on opposite sides on the diagonal, as the control shaft is rotated, it pulls the two control arms in opposite directions. This causes each set of louvers to move in opposite directions. The advantage of movable louvers is that they can be used with both heating and cooling cycles. To operate the louvers, the control shaft can be turned by hand. Alternatively, a bi-metallic strip, installed around the control shaft, can be used to turn the control shaft depending on the temperature of the air exiting the register.

15 Claims, 8 Drawing Sheets

FORCED AIR REGISTER WITH LOUVER CONTROL AND METHOD OF CONSTRUCTION THEREOF

This invention relates to forced air heat register and particularly to forced air heat registers with louver controls.

BACKGROUND OF THE INVENTION

Heat registers for forced air heating systems have been used for a long time. Today's heat registers are typically rectangular. They have a top plate that has a set of formed louvers. A lower rectangular box is attached to install the register in a floor. A set of rotatable dampers is installed in the box to control the amount of air through the register. Most registers are built of lightweight metal or plastic and are welded, or riveted together or formed by injection molding. Virtually all household registers have fixed louvers formed in the cover.

There are air handling louver systems that have movable louvers. These tend to be larger industrial models. Some of these designs use bi-metallic strips to operate the louvers. In cold weather, for example, the louvers are closed. As the temperature increases, the bi-metallic strip causes the louvers to open, thereby increasing ventilation. Some examples of these louver systems are found in U.S. Pat. No. 2,698,570 to Feinberg, U.S. Pat. No. 2,117,529 to Wile et al., and U.S. Pat. No. 3,068,776 to Day. As noted above, these designs are large and have simple mechanisms that open and close the louvers as a unit.

SUMMARY OF THE INVENTION

Although movable louver systems exist, none have been used in operating floor registers because putting movable louver systems into household registers is costly. Also, the movable louvers systems are too large for household louvers. The configurations of the louver systems described above would have to be modified to fit into a typical home heating outlet. Moreover, the simple operating systems of these louvers limit the louver's movement to only one direction or the other.

Unlike the units discussed above, the present invention achieves the desired results in a compact, design. The adjustable louver register is designed to have the same overall dimensions of commercial registers available today. Like ordinary registers available today, the register has a register body (the lower box) in which a set of standard dampers are installed. Unlike those registers, the instant invention has movable louvers installed on pivots that are formed in the register body. The louvers are mounted to freely pivot in place and are organized into two groups. Two control arms are used to pivot the groups of louvers. One control arm operates the louvers on the left side of the register. The second control arm operates the louvers on the right side of the register. The control arms are mounted on diagonals from each other. Both control arms are attached to a central control shaft. The central control shaft is designed to rotate about its central axis. Because the control arms are mounted on opposite sides on the diagonal, as the control shaft is rotated, it pulls the two control arms in opposite directions. This causes each set of louvers to move in opposite directions. Thus, in the normal, at rest position, both sets of louvers are vertical and upright. As the control shaft is turned clockwise, the left side louvers pivot toward the left end of the register and the right side louvers pivot toward the right side. The shaft has a range that causes the louvers to pivot to a 45 degree angle in their fully opened positions.

The advantage of movable louvers is that they can be used with both heating and cooling cycles. Today's fixed registers direct air in one direction (usually at a downward angle and pointing away from the registers). This is all right for heating because it is desired to have hot air distributed over the floor, where is can rise, warming the entire space more efficiently. In a cooling cycle, however, pushing cool air outwards across the floor keeps the cool air low, making it more difficult to cool the upper portions of the room. The optimum direction to direct cooling air is straight up towards the ceiling, where it can then circulate around the room and sink, cooling the upper parts of the room as well as the floor area. The movable louver system in the present invention is ideally suited to deliver air in the optimum manner for the appropriate cycle-heating or cooling. Moreover, system is automatic so that if the forced air system is blowing cool air, the louvers direct it upwards, and as heat is called for and sent into the registers, the louvers automatically turn toward the optimum angle for delivering warm air into the space. The louvers remain in the warming position until the heating cycle is complete, after which, the louvers automatically return to the vertical position ideal for cooling.

To operate the louvers, the control shaft can be turned by hand. Alternatively, a bi-metallic strip, installed around the control shaft, can be used to turn the control shaft depending on the temperature of the air exiting the register.

DETAILED DESCRIPTION OF THE INVENTION

Figure 1:
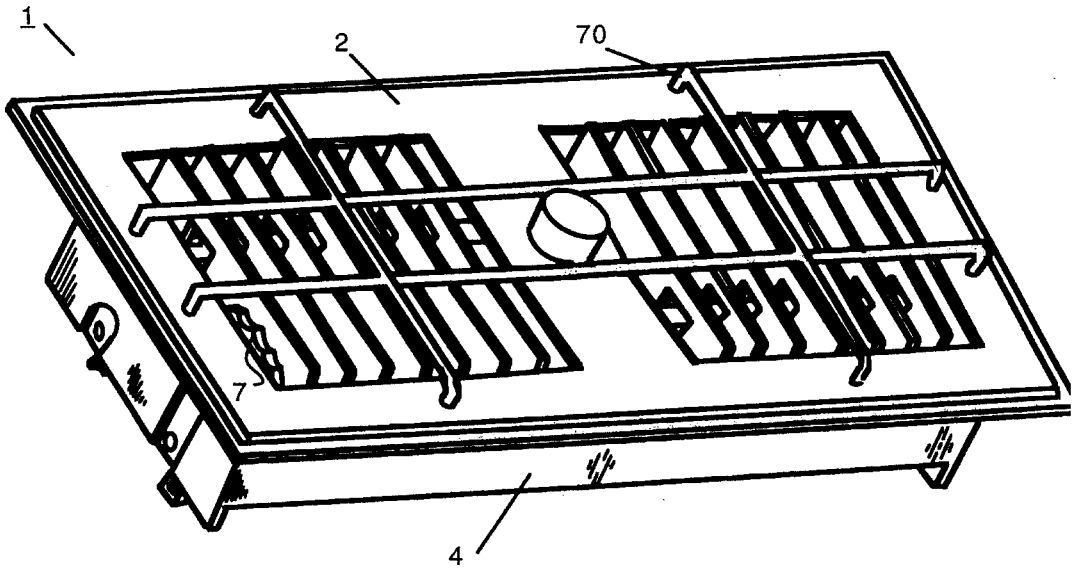
FIG. 1 is a perspective view of the invention.

Referring now to the drawings and particularly to FIGS. 1–7, the register grill 1 is shown. The register grill 1 is assembled from several components that in themselves are sub assemblies. In the preferred embodiment, the components are made of injection molded plastic. Although not preferred, lightweight metal may be used as well.

FIGS. 1, 2, 3 and 4 show the fully assembled register grill 1 in different views. The register grill 1 has a register top cover 2, which is attached to a register body 4. A pair of dampers 5 are provided and are installed in a manner common to the art, using pins 6 and a control wheel 7 to open and close the dampers 5. The control wheel 7 is attached to a gear system that turns the dampers 5 in the desired direction. This damper system is identical to the dampers and damper controls found on ordinary register grills common to the art.

Figure 5:
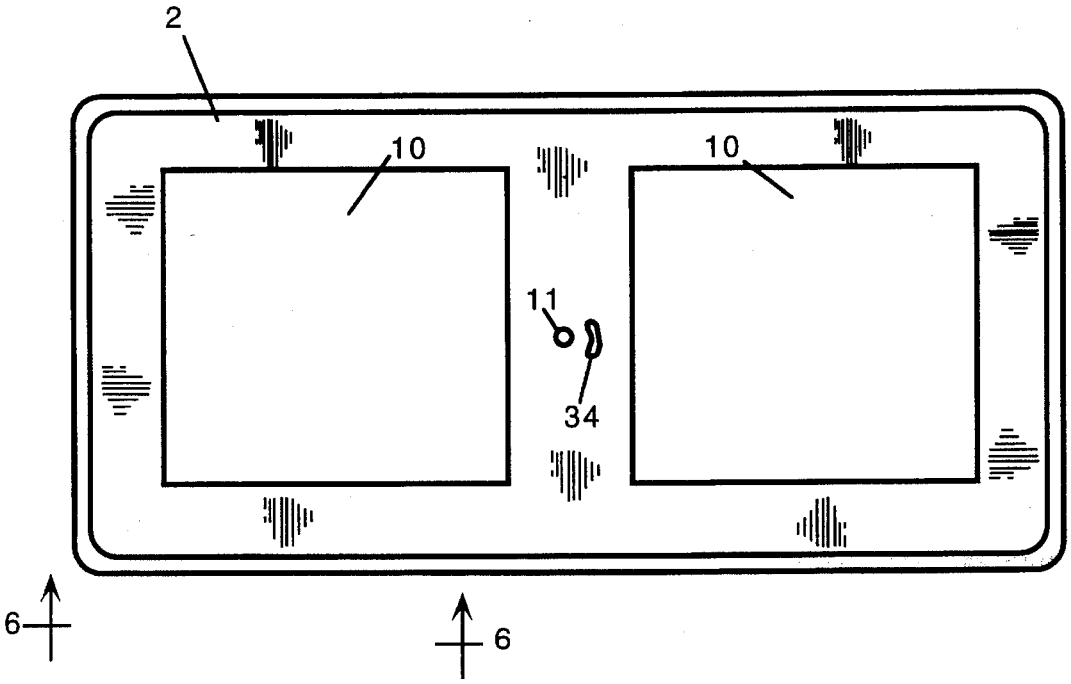
FIG. 5 is a top view of the register cover.

Referring to FIG. 5, the register top cover 2 is shown. Unlike all commercial grills available today, the register top cover 2 does not have preformed fixed louvers. Rather, there are two openings 10 formed in the register cover 2 that accept the movable louvers 12. The register top cover 2 also has an opening 11 to accommodate the central control knob 32 and a slot 34 for guide pin 33. See FIG. 17.

Figure 6:
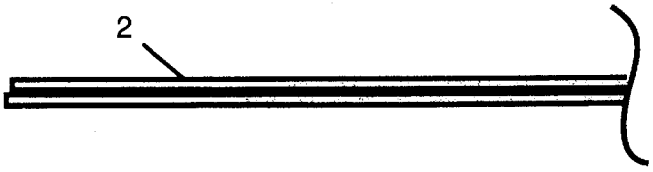
FIG. 6 is a side detail view of the register cover taken along the lines 6—6.
Figure 7:
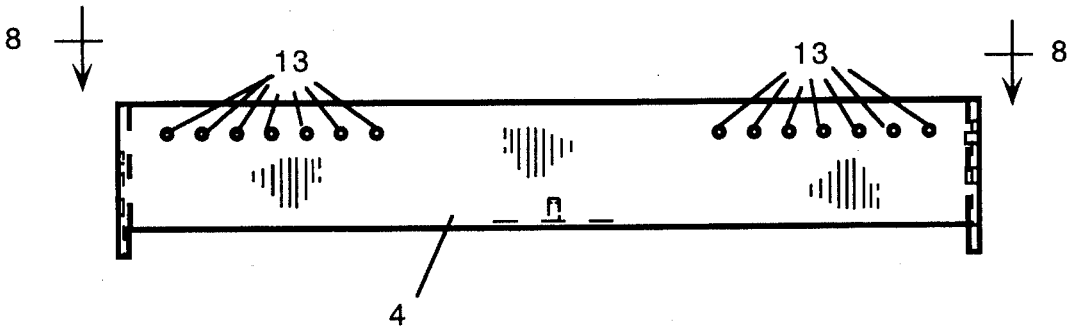
FIG. 7 is a side view of the register body.
Figure 8:
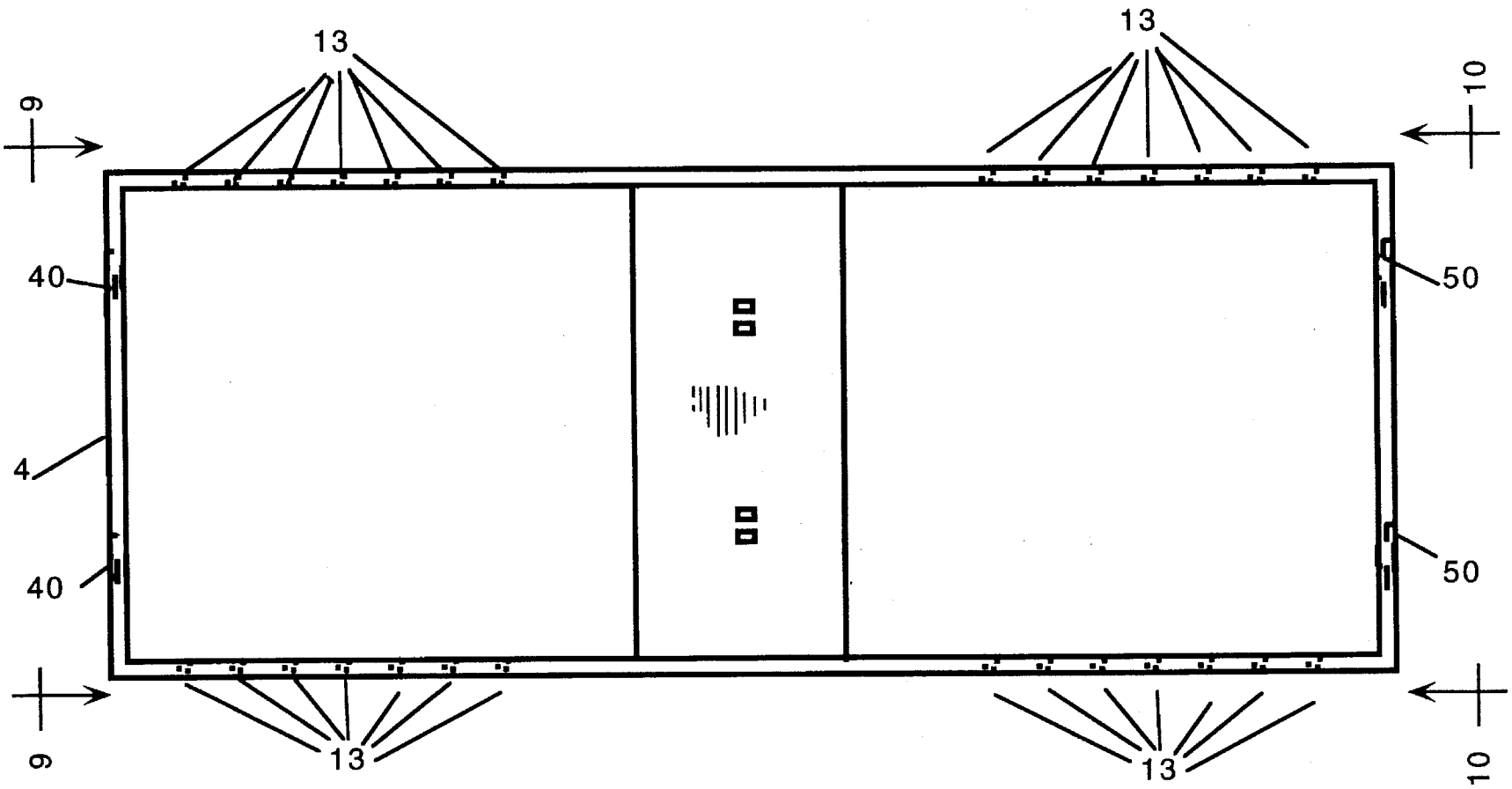
FIG. 8 is a top view of the register body taken along the lines 8—8.

The register top cover 2 is formed of plastic or similar material and has the shape as shown in FIGS. 5 and 6.

FIGS. 7, 8, 9 and 10 show the register body 4. The register body 4 is a rectangular frame that support the dampers 5 and the associated controls. The register body 4 also has a number of holes 13 formed in the edges of the side walls. These holes 13 are designed to hold the individual moveable louvers 12. In the preferred embodiment, the register body 4 can be molded or cast in one piece, or can be assembled from cast or molded pieces.

Figure 9:
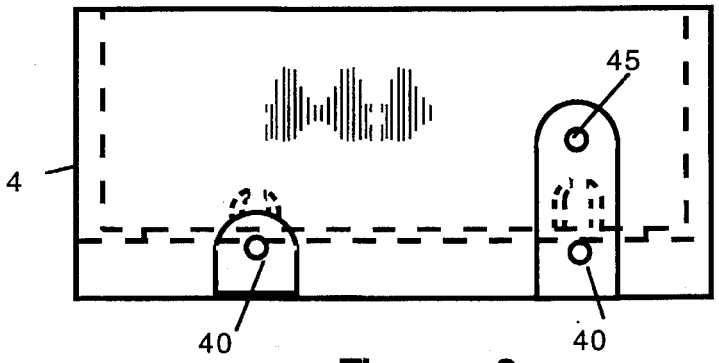
FIG. 9 is a left end view of the register body taken along the lines 9—9.
Figure 10:
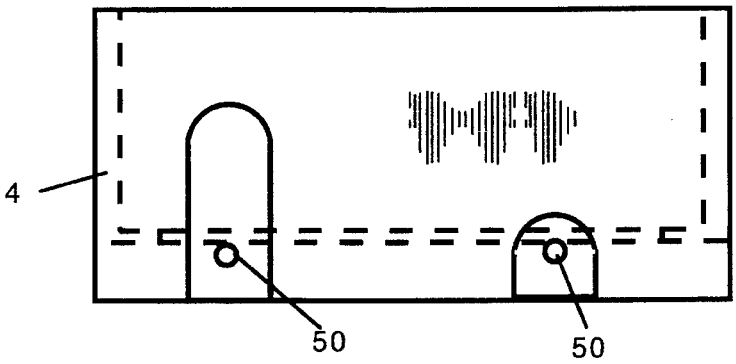
FIG. 10 is a right end view of the register body taken along the lines 10—10.
Figure 11:
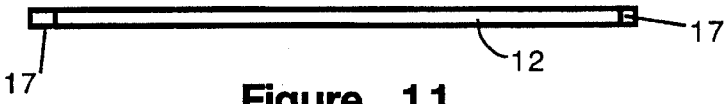
FIG. 11 is a top view of a typical louver.
Figure 13:
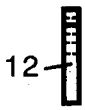
FIG. 13 is an end view of a typical louver.
Figure 12:
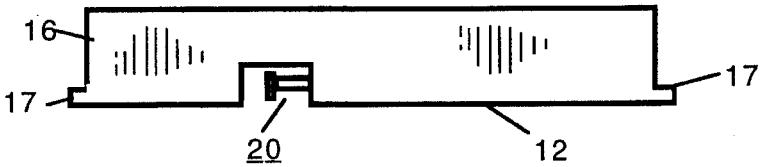
FIG. 12 is a front view of a typical louver.
Figure 14:
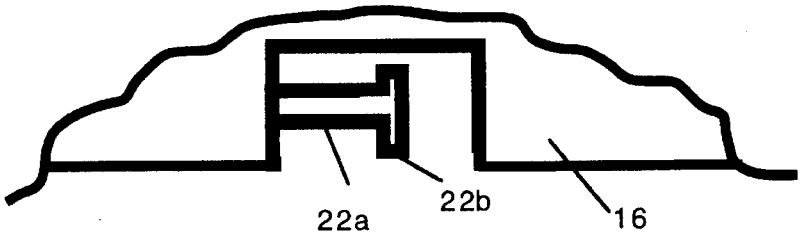
FIG. 14 is a detail view of the tab portion of a typical louver, shown as an inset.

FIGS. 9 and 10 show side support mounting holes 40 and 50 for mounting the dampers 5. Additionally, hole 45 is used to mount the damper control wheel 7.

Figure 15:
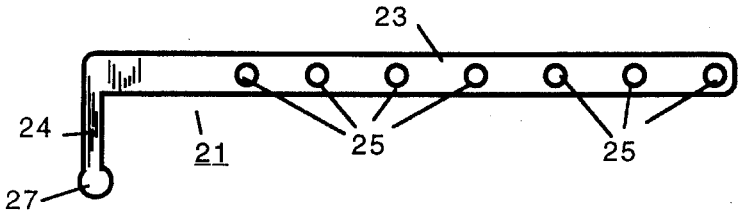
FIG. 15 is a side view of a lever control arm.

FIGS. 11, 12, 13 and 14 show details of the movable louvers 12. The movable louvers 12 have a generally rectangular body 16. At the bottom of the rectangular body 16 are two tabs 17 as shown. The tabs 17 are designed to fit within the holes 13. The tabs 17 allow the moveable louvers 12 to pivot about the holes 13. Each moveable louver 12 has an operating tab 20 formed as shown. The operating tab 20 has an extension 21*a* and an end tab 21*b*. The operating tab 20 is designed to interlock with an operating arm 21. See FIG. 15. There are two operating arms 21 located on opposite sides of the centerlines of the device, thus, the operating arms 21 are located on the diagonal of the register body 4. Each operating arm 21 has a series of holes 25 that fit over the operating tab 20 on each moveable louver 12. Once the operating arm 21 has been placed over an operating tab 20, it is clipped into place on the tab 20. One end 22 of the operating arm 21 is flat. The other end of the operating arm 21 is formed into a bent rod 24 as shown. A ball 27 is formed at the base of the bent rod 24. The bent rod 24 is attached to the control arm 30. The ball 27 holds the operating arm 21 in place.

Figure 2:
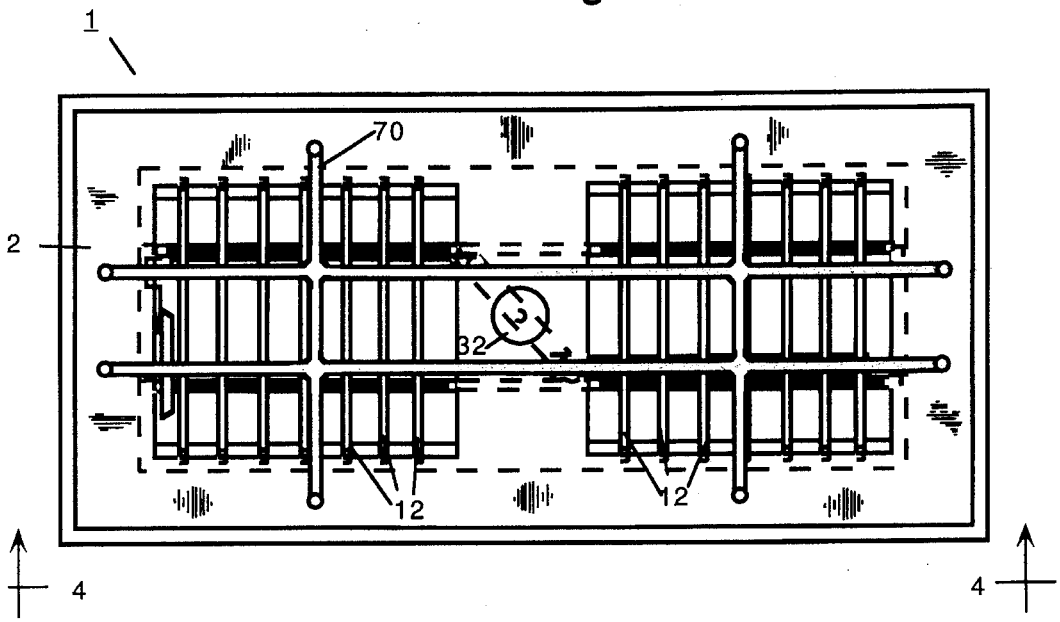
FIG. 2 is a top view of the invention with the protective grate.
Figure 3:
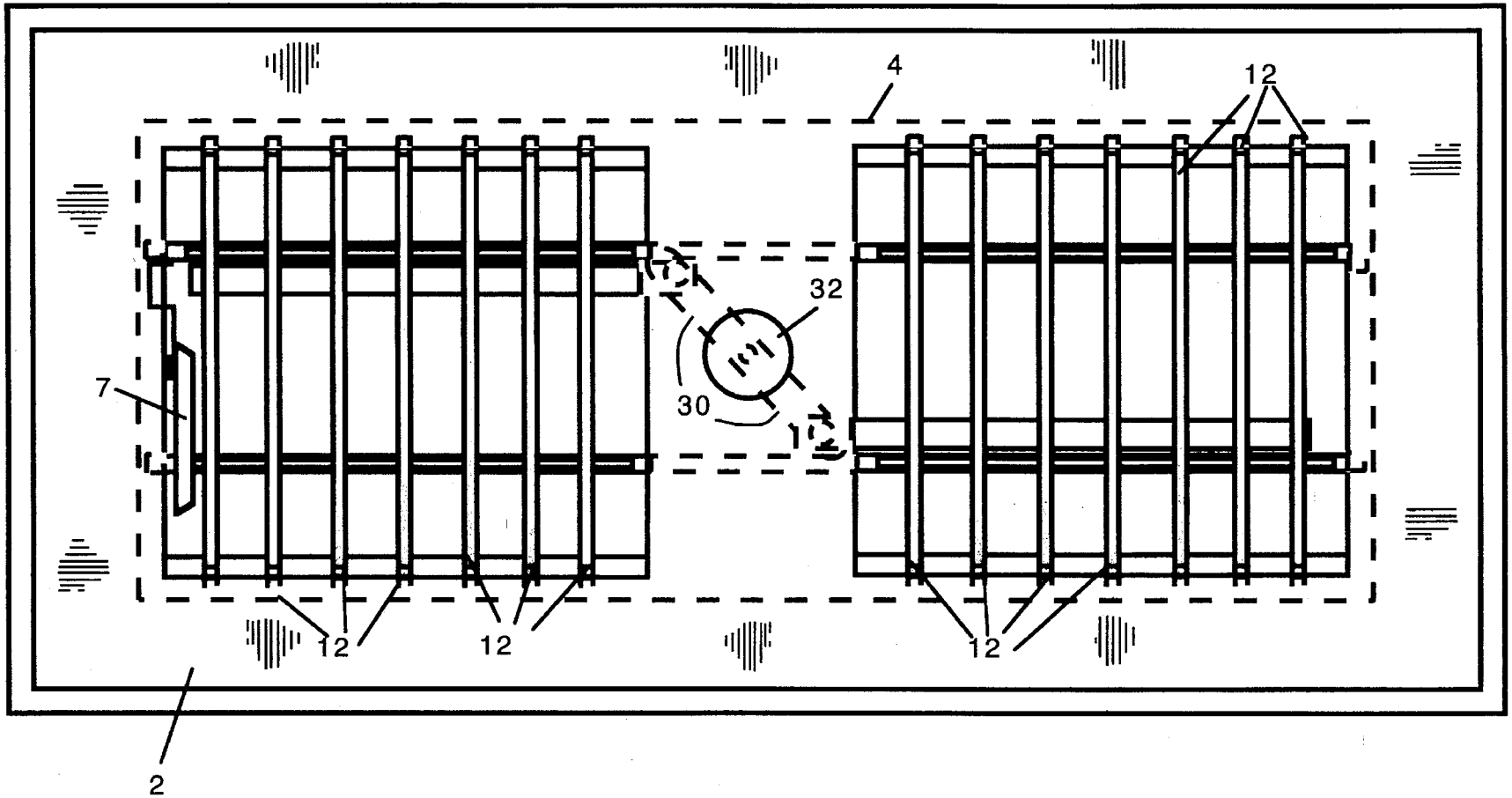
FIG. 3 is a top view of the invention with the protective grate removed.
Figure 4:
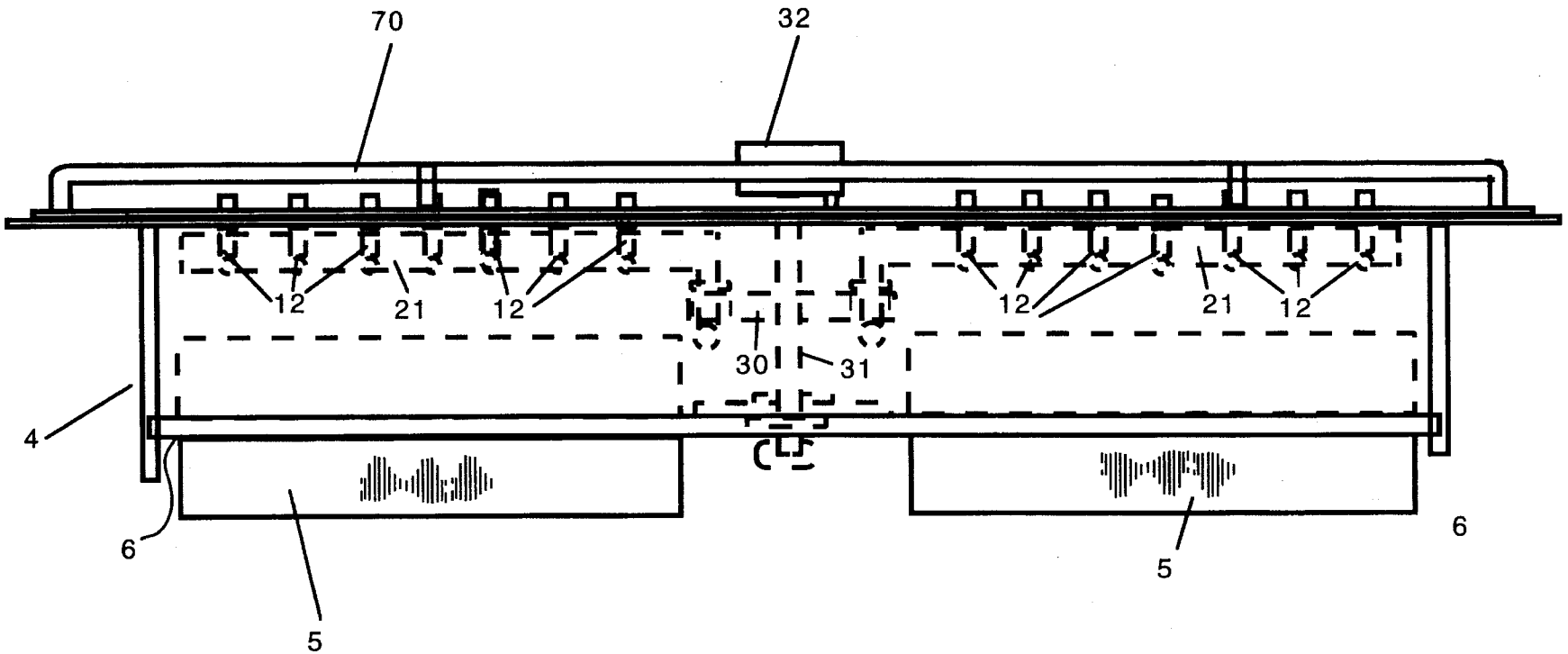
FIG. 4 is a side view of the invention with the protective grate installed., taken along the lines 4—4.
Figure 16:
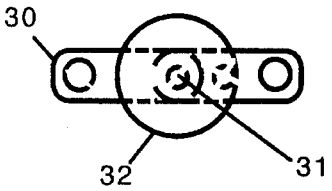
FIG. 16 is a top view of the manual control system.

Referring now to FIGS. 2, 3, and 16, the control arm 30 is attached to the operating arms 21 as shown. A control shaft 31 passes through the center of the control arm 30 as shown. The control shaft 31 is attached to the control arm 30 such that the control arm 30 is turned when the control shaft 31 is turned.

Figure 17:
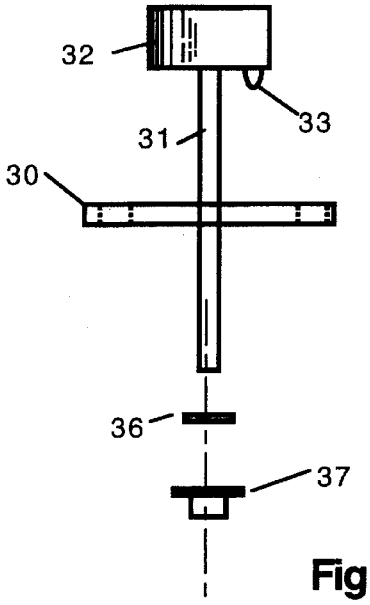
FIG. 17 is a side view of the manual control system.
Figure 18:
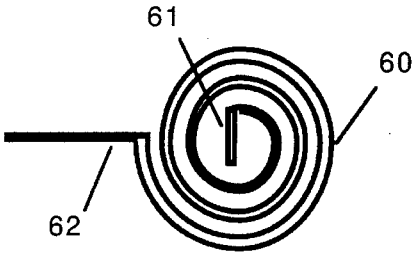
FIG. 18 is a top view of the bi-metallic strip.
Figure 19:
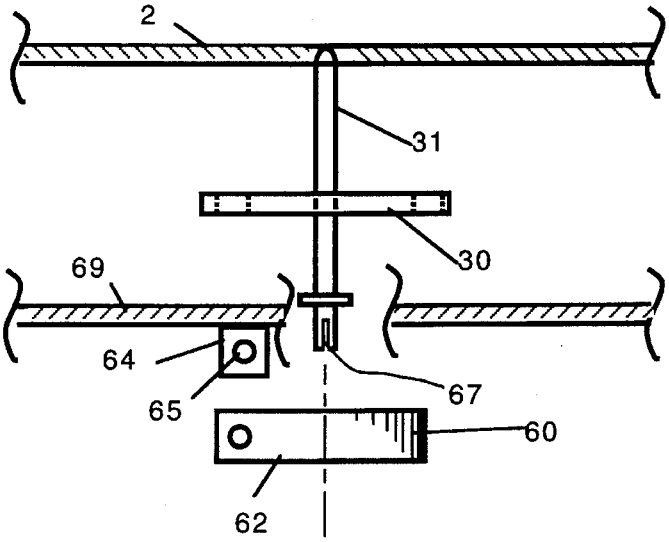
FIG. 19 is a side view of the control mechanism with a bi-metallic strip in place.

Two operating modes are contemplated. FIGS. 16 and 17 show the components for manual operation of the device. FIGS. 18 and 19 show the components for the preferred embodiment; a system utilizing a bi-metallic strip.

The manual operating system has the control arm 30 attached to the control shaft 31 as shown. A manual control knob 32 is attached to the top of the control shaft 31. In practice, the knob 32 is mounted above the top surface of the register top cover 2. See FIGS. 2 and 3. A guide pin 33 (see FIG. 17) is provided. This pin fits into slot 34 shown in on FIG. 5. The guide pin is used to properly locate the louvers in their proper position relative to the mode of ventilation, i.e., heating (at an angle) or cooling (vertical). In this embodiment, the control shaft 31 is secured to the register using a washer 36 and a cap nut 37.

The preferred embodiment uses a bi-metallic strip 60, as shown in FIG. 18. The bi-metallic strip 60 has a spiral structure that has a straight center piece 61 and a straight end tail 62. The end tail 62 has a mounting hole 63 formed in it to allow the bi-metallic strip 60 to be fastened to the register body 4. FIG. 19 shows how the bi-metallic strip 60 is fastened to the register body 4. The bottom 69 of the register body 4 has a mounting plate 64 that has a hole 65 for fastening the bi-metallic strip 60, using a speed nut or similar fastener. The control shaft 31 in this embodiment has a slot 67 formed in the bottom of the shaft 31 as shown. This slot 67 aligns with and receives the straight center piece 61 of the bi-metallic strip 60. By fastening the tail end 62 of the bi-metallic strip 60 and by connecting the shaft to the straight center piece 61 of the bi-metallic strip 60, the shaft 31 turns when the bi-metallic strip 60 expands or contracts.

Figure 20:
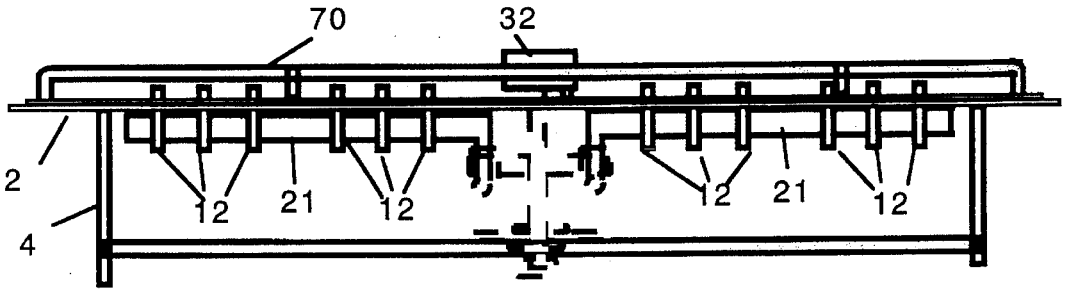
FIG. 20 is a side view of the louvers in the normal at rest position.
Figure 21:
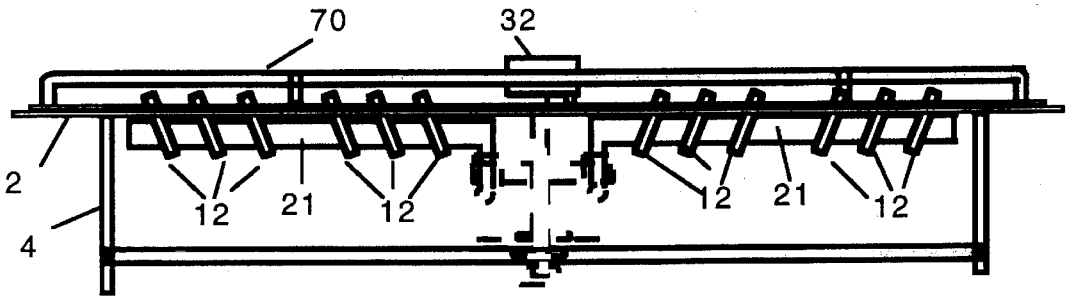
FIG. 21 is a side view of the louvers in an intermediate position.
Figure 22:
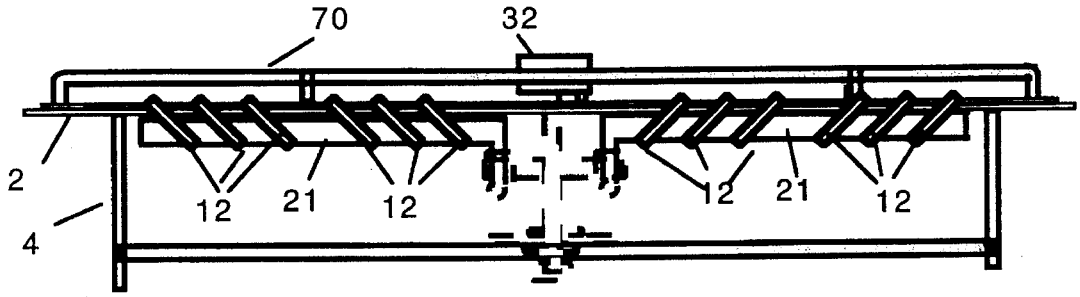
FIG. 22 is a side view of the louvers in the full heat position.

Referring to FIGS. 20, 21, and 22, the movement of the louvers is shown. FIG. 21 shows the device in the cool air mode. In this mode, the bi-metallic strip 60 is fully relaxed. In the case of the manual control, the control shaft 31 is in the full counter clockwise position. As heat enters the register from below, the bi-metallic strip 60 begins to move. As it moved, it turns the control shaft 31 in a clockwise direction, causing the louvers 12 to move into the intermediate position shown in FIG. 21. As the bi-metallic strip 60 is fully heated, it reaches its extreme position, in which the louvers 13 are held at 45 degree angles, each set of louvers 13 pointing in the opposite direction. This position is shown in FIG. 22. After the heating cycle is completed, as the system cools, the louvers 13 are moved back to the "at rest" position of FIG. 20.

The same operating action can be accomplished by turning the control knob in the manual system. Of course, the manual system lacks the ability to automatically adjust the louvers as the temperature of the air coming from the register changes. This is why the manual system is not preferred.

Another unique aspect of this register is the method of construction. Unlike fixed louver registers, where the louvers are fixed and either welded, cast or molded in place (depending on the type of material used), the instant invention is designed to be snapped together using molded plastic components. This reduces the cost of manufacture because no complex metal working is required. Because the components snap together ( i.e., the louvers 12 into the holes 13 in the register body 4 and the operating arms 21 into the control arm 30 and the louver's operating tabs 20), assembly is quick and efficient. Finally, the registers can be built with a protective grate 70 (see, e.g., FIGS. 1, 2 and 4). The protective grate 70 helps to prevent damage to the movable louvers 13 and protects the user from possible injury. The grate 70 can be attached to the register top cover 2 by glue, or other similar methods.

Because the preferred embodiment uses plastic, there is less chance for the user to be burned by a register. Metal registers can become very hot and can burn people who might touch the register. Plastic has a lower tendency to hold heat, making it less likely to cause burns. Plastic is also preferred because the registers can be colored to match any color desired. Moreover, plastic does not rust, which inhibits louver movement in metal registers. Using plastic enables the registers to operate without maintenance for many years.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A heating and cooling forced air register comprising:

a) a top plate having a first opening and a second opening formed therein and also having a left side and a right side;

b) a register body, fixedly attached to said top plate;

c) a first set of movable louvers, pivotably attached to said register body such that said first set of movable louvers is aligned with and passes through said first opening in said top plate;

d) a second set of movable louvers, pivotably attached to said register body such that said second set of movable louvers is aligned with and passes through said second opening in said top plate;

e) a first operating means for pivoting said first set of movable louvers, being attached to said first set of louvers;

f) a second operating means for pivoting said second set of moveable louvers, being attached to said second set of movable louvers;

g) a means for simultaneously moving said first and second operating means, including a control arm in rotational communication with said first and second operating means; a control shaft, fixedly and perpendicularly attached to said control arm, whereby when said control shaft is rotated, said control arm is rotated; and a means for rotating said control shaft.

2. The heating and cooling forced air register of claim 1 wherein said first and second operating means for pivoting said first and second sets of movable louvers comprise a pair of operating arms, being pivotably connected to said first and second sets of movable louvers.

3. The heating and cooling forced air register of claim 1 further comprising a pair of dampers being pivotably mounted within said register body.

4. The heating and cooling forced air register of claim 1 further comprising a protective grate, fixedly attached to said top cover to protect said movable louvers from damage.

5. The heating and cooling forced air register of claim 1 wherein the means for rotating said control shaft comprise a manual control knob, fixedly attached to said control shaft.

6. The heating and cooling forced air register of claim 1 wherein the means for rotating said control shaft comprise:

a) a bi-metallic strip having an end and a center, said center being fixedly attached to said control shaft; and b) means for securing said end of said bi-metallic strip to said register body.

7. A heating and cooling forced air register comprising:

a) a top plate, having a first opening and a second opening formed therein and also having a left side and a right side, and being generally rectangular;

b) a register body, being generally rectangular and having a first long side and a second long side, fixedly attached to said top plate and having a plurality of holes formed in said first and second long sides said plurality of holes being oppositely disposed and in alignment;

c) a first set of movable louvers having a plurality of individual louvers, each individual louver having a pair of pivot tabs fixedly mounted thereon and being pivotably attached to said register body, and each individual louver also having an operating tap integrally formed therein, said first set of louvers being installed such that said first set of movable louvers is aligned with and passes through said first opening in said top plate;

d) a second set of movable louvers having a plurality of individual louvers, each individual louver having a pair of pivot tabs fixedly mounted thereon and being pivotably attached to said register body, and each individual louver also having an operating tap integrally formed therein, said second set of louvers being installed such that said second set of movable louvers is aligned with and passes through said second opening in said top plate;

e) a first operating arm pivotably attached to the operating taps in said first set of louvers;

f) a second operating arm pivotably attached to the operating taps in said second set of louvers;

g)a control arm in rotational communication with said first and second operating arms;

h) a control shaft fixedly and perpendicularly attached to said control arm whereby when said control shaft is rotated, said control arm is rotated; and i) a means for rotating said control shaft.

8. The heating and cooling forced air register of claim 7 wherein the means for rotating said control shaft comprise a manual control knob, fixedly attached to said control shaft.

9. The heating and cooling forced air register of claim 7 wherein the means for rotating said control shaft comprise:

a) a bi-metallic strip having an end and a center, said center being fixedly attached to said control shaft; and b) means for securing said end of said bi-metallic strip to said register body.

10. The heating and cooling forced air register of claim 7 further comprising a protective grate, fixedly attached to said top plate to protect said first and second sets of movable louvers from damage.

11. The method of constructing a heating and cooling forced air register comprising the steps of a) forming a top plate having a first opening and a second opening formed therein and being generally rectangular;

b) forming a register body being generally rectangular and having a first long side and a second long side, c) forming a plurality of holes in said register body such that said plurality of holes are oppositely disposed and in alignment;

d) installing a first set of movable louvers within said register body, the first set of movable louvers having a plurality of individual louvers, each individual louver having a pair of pivot tabs fixedly mounted thereon and being pivotably attached to said register body, and each individual louver also having an operating tap integrally formed therein, said first set of louvers being installed such that said first set of movable louvers is aligned with and passes through said first opening in said top plate;

e) installing a second set of movable louvers in said register body, the second set of movable louvers having a plurality of individual louvers, each individual louver having a pair of pivot tabs fixedly mounted thereon and being pivotably attached to said register body, and each individual louver also having an operating tap integrally formed therein, said second set of louvers being installed such that said second set of movable louvers is aligned with and passes through said second opening in said top plate;

g) installing a first operating arm such that said first operating arm is pivotably attached to the operating taps in said first set of louvers;

h) installing a second operating arm such that said second operating arm is pivotably attached to the operating taps in said second set of louvers;

j) attaching a control arm to said first and second operating arms;

k) attaching a control shaft, fixedly and perpendicularly, to said control arm whereby when said control shaft is rotated, said control arm is rotated;

l) attaching a means for rotating said control shaft to said control shaft; and m) attaching said top plate to said register body.

12. The method of constructing a heating and cooling forced air register of claim 11 wherein the step of attaching a means for rotating said control shaft comprises the step of attaching a manual control knob to said control shaft.

13. The method of constructing a heating and cooling forced air register of claim 11 wherein the step of assembling a means for rotating said control shaft comprises the step of:

a) attaching a first end of a bi-metallic strip to said control shaft; and b) attaching a second end of said bi-metallic strip to said register body.

14. The method of constructing a heating and cooling forced air register of claim 11 wherein the step of attaching said top plate to said register body comprises the step of injection molding the register body and top plate together, as a one piece unit.

15. The method of constructing a heating and cooling forced air register of claim 11 further comprising the step of attaching a protective grate to said top plate to protect said movable louvers from damage.

* * * * *